United States Patent [19]

Pinto et al.

[11] Patent Number: 4,993,117

[45] Date of Patent: Feb. 19, 1991

[54] OPENING DEVICE WITH METAL DETECTOR AND STOP-OFF

[75] Inventors: Akiva Pinto, Duesseldorf Wittlaer; Guenter LucaBen, Haltern; Reinhard Schmidt, Gescher, all of Fed. Rep. of Germany

[73] Assignee: Hergeth Hollingsworth GmbH, Dülmen, Fed. Rep. of Germany

[21] Appl. No.: 472,994

[22] Filed: Jan. 31, 1990

[30] Foreign Application Priority Data

Feb. 3, 1989 [DE] Fed. Rep. of Germany ... 8904766[U
Apr. 17, 1989 [DE] Fed. Rep. of Germany ..... 3912564

[51] Int. Cl.[5] ..... D01G 9/20
[52] U.S. Cl. ..... 19/80 R
[58] Field of Search ..... 19/80 R, 80 A, 81, 82

[56] References Cited

U.S. PATENT DOCUMENTS 4,493,131 1/1985 Deagagna et al. ..... 19/80 R
4,510,646 4/1985 Locatelli et al. ..... 19/80 R
4,805,266 2/1989 Leifeld et al. ..... 19/80 R

FOREIGN PATENT DOCUMENTS 3436498 4/1986 Fed. Rep. of Germany ..... 19/80 R
1207628 9/1986 Japan ..... 19/80 R
3274863 11/1988 Japan ..... 19/80 R
364694 5/1971 U.S.S.R. ..... 19/80 R

*Primary Examiner*—Werner H. Schroeder
*Assistant Examiner*—John J. Calvert
*Attorney, Agent, or Firm*—Bailey & Hardaway

[57] ABSTRACT

In an opening device for opening pressed fibre bales, e.g. cotton and viscose fibre bales and the like, by means of a reduction device, e.g. a milling device, being translationally movable over the surface of a bale or a row of bales, the reduction device having at least one milling roll with pressure rolls (17, 18) being disposed axially parallel on both sides of the reduction device, opener discs (14), provided on the milling rolls (3,4) meshing with a grate (10), the grate bars (11) of which lie between the opener discs (14) that engage the bale surface, and with a metal detector device, it is provided that the grate bars (11) are extended towards the pressure rolls (17, 18) to the immediate vicinity of the pressure rolls (17,18), and that the metal detector device is formed by the grate bars (11) and said pressure rolls (17, 18), the grate bars (11) forming a first contact surface and the pressure rolls (17, 18) forming a second contact surface.

6 Claims, 2 Drawing Sheets

OPENING DEVICE WITH METAL DETECTOR AND STOP-OFF

The invention relates to an opening device for opening pressed fibre bales by means of a reduction device movable over the surface of a bale or a row of bales, the reduction device having at least one opening roll, pressure rolls being disposed axially parallel on both sides of the reduction device, milling discs provided on each of the opening rolls, meshing with a grate having bars between the milling discs that engage the bale surface, and a metal detector device.

BACKGROUND OF THE INVENTION

Such opening devices are used for reducing fibre bales, in particular firmly pressed fibre bales, e.g. of cotton, synthetic fibres and the like, a reduction device being translationally moved over the surface of a bale or a row of bales. This reduction device may consist e.g. of a milling device with pressure rolls disposed axially parallel on both sides of the reduction device, respectively. The milling head is provided with a grate, the grate bars of which are positioned between the milling discs, the opening device and the fibre bales passing each other and the teeth of the milling discs engage into the fibre bales through the grate bars.

Such an opening device, like e.g. the bale opening system Optomix II by Hergeth Hollingsworth GmbH, is provided with a metal detector device. In this case, the grate is suspended insulated at the housing of the milling head, a sudden stop of the apparatus being caused, e.g., upon the occurrence of an electrical contact between a milling disc and a grate bar to prevent damage to the milling device and the occurrence of sparks that could cause a fire.

This metal detector device with an insulated grate allows the detection of metal only when the metal particle, e.g. fragments of the rims around the bales consisting for example of metal bands, present in the fibre bale gets into the region of the working area of a milling disc. With a view to fire protection, this may already be too late, because already the first contact of a metal fragment and the milling disc may lead to sparking.

It is the object of the invention to provide an opening device in which a reliable and early detection of metal is possible without the danger of sparking.

The object is solved according to the invention by the features of the main claim.

According to the invention, the grate bars extend towards the pressure rolls to the immediate vicinity thereof, and the metal detector device includes the grate bars and the pressure rolls. The grate bars form a first contact surface, and the pressure rolls form a second contact surface, and define a gap therebetween whereby the pressure rolls and the grate bar serve as a metal detector.

In a preferred embodiment it is provided that the pressure rolls consist of a roll with a metallic surface, insulated against the casing. In this way, the grate does not have to be insulated against the casing, which eliminates complex holding means otherwise necessary with a view to the great pressure forces occurring when opening a bale.

In a double-roll opening system with mutually offset milling discs arranged on two parallel rolls, the grate bars immediately extend from the one pressure roll to the working area of the milling disc arranged in front of the other pressure roll. In this manner, the grate bars overlap in the central portion between the milling rolls, the bars being mechanically and electrically connected via a fixing means extending parallel to the milling rolls.

It is provided in a further embodiment that the pressure rolls and the milling discs form the ground potential of the metal detector device together with the casing, whereas the grate is insulated and mounted at the casing. In this way, it is possible to detect metal rather early, i.e. both at the level of the pressure roll and at the level of the milling disc, since the teeth of the milling rolls also have the ground potential.

The gap between the ends of the grate bars and the working or engaging range of the pressure rolls or the opener discs, respectively, has a width of approximately 5 to 15 mm, preferably 8 mm.

BRIEF DESCRIPTION OF THE DRAWINGS

The following is a detailed description of embodiments of the present invention taken in conjunction with the accompanying drawings.

In the Figures.

DESCRIPTION OF A PREFERRED EMBODIMENT

Figure 1:
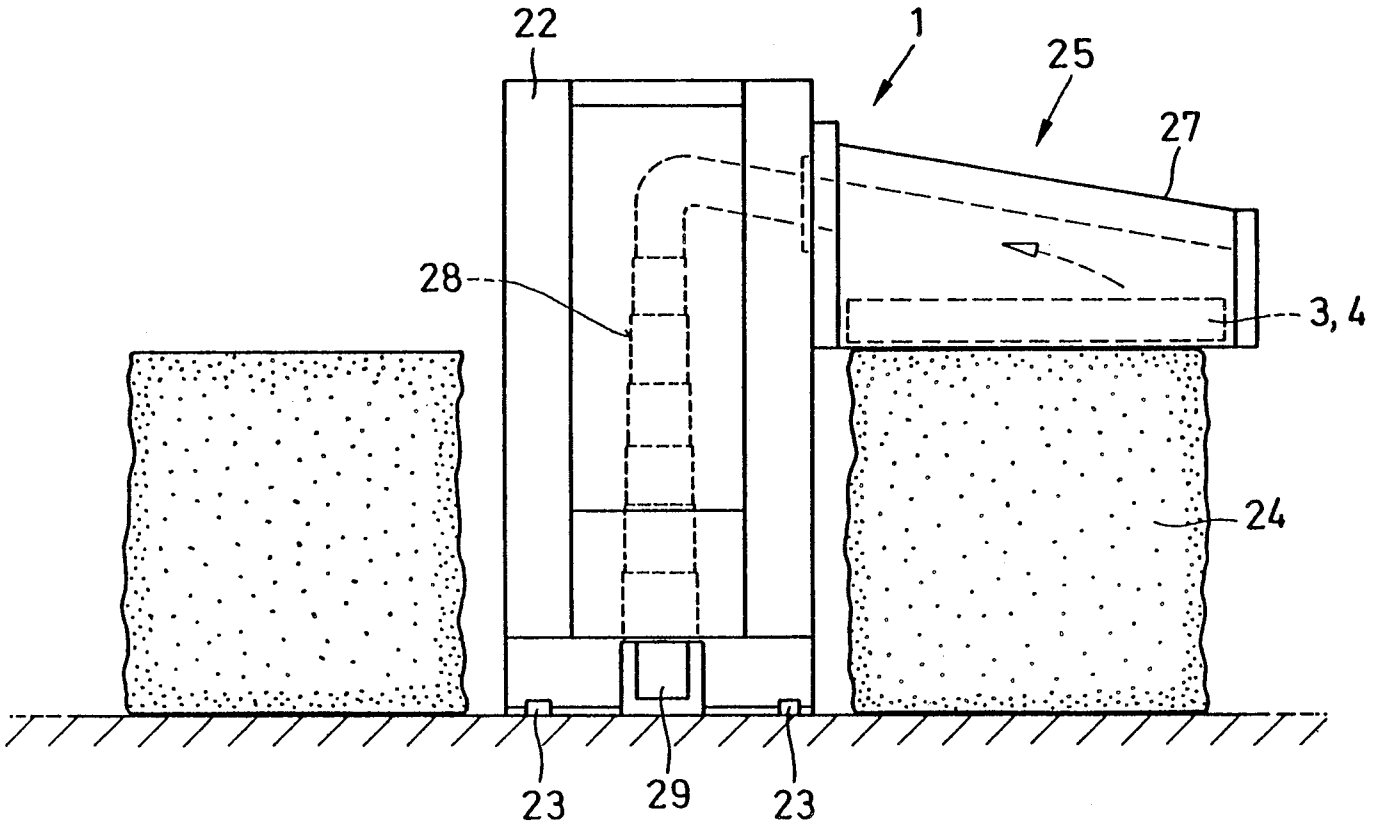
FIG. 1 is a schematic view of an opening device for fibre bales according to the present invention.
Figure 2:
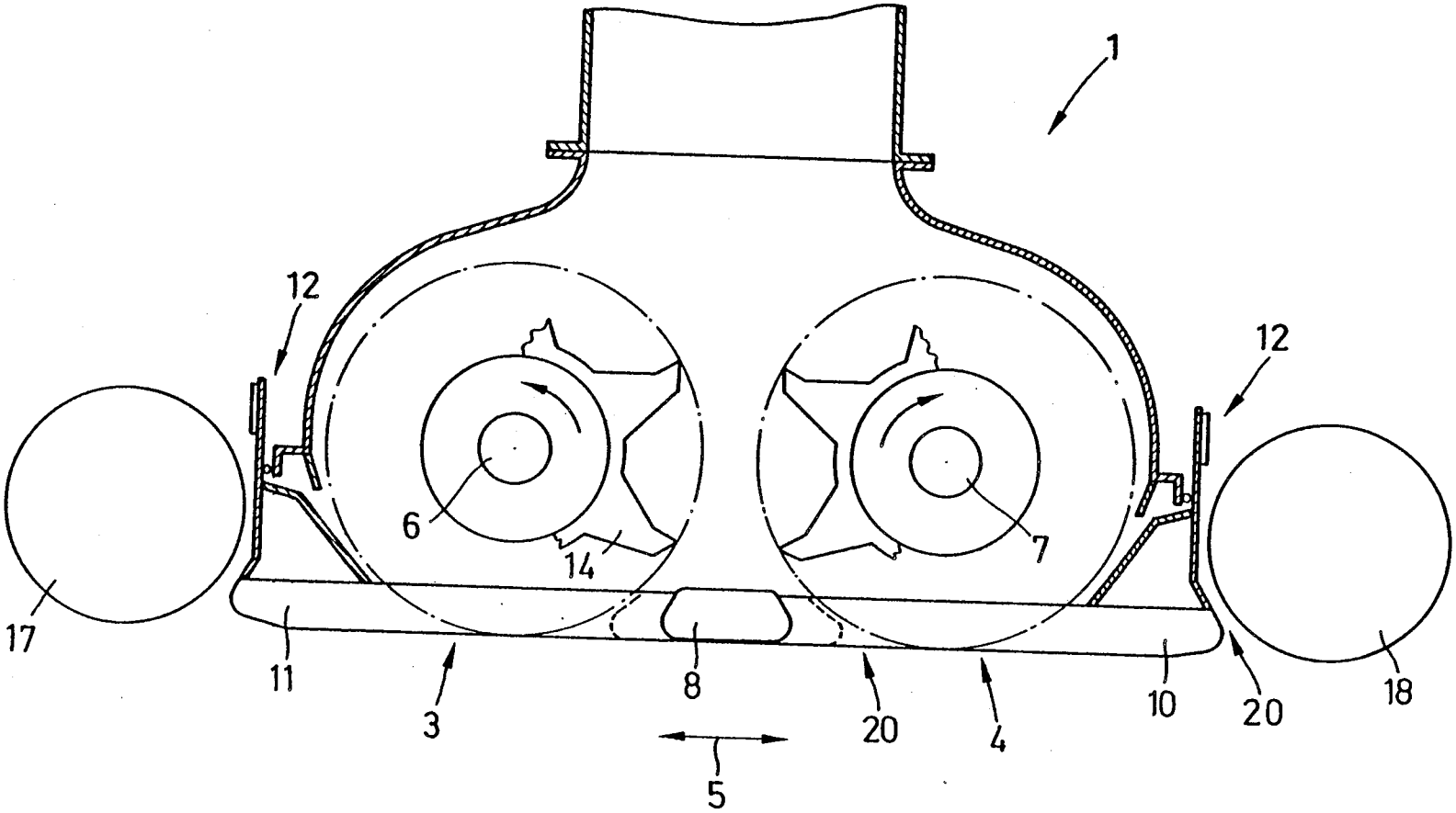
FIG. 2 is a cross section of a part of the milling head.

The opening device 1 for pressed fibre bales 24 standing in line comprises a tower 22 translationally movable on tracks 23 along the row of bales 24. The tower is provided with an arm 25 secured to one side of the tower 22 by means of a flange. The housing 27 of the arm 25 accommodates a milling device consisting of two opener rolls 3,4 that rotate in opposite directions towards the centre of the pair of rolls and take off fibres and tufts from the upper surface of the row of bales 24, throwing them upward between them. By virtue of a pneumatic suction stream, the detached fibres and the like get inside the tower 22 via a socket, in which a telescope guide device 28 leads to a lower suction channel 29. The arm 25 will be lowered corresponding to the decreasing height of the fibre bales.

Both opener rolls 3, 4 are arranged successively in the direction of movement as indicated by arrow 5. The opener rolls 3,4 are supported by axes 6,7 connected with drive means. The opener rolls 3, 4 are provided with milling discs 14 axially arranged in a certain distance from each other. The opener rolls 3,4 cooperate with a grate 10 composed of a series of grate bars 11 positioned in a predetermined distance from each other. The grate 10 is secured to a mounting 12 in a height-adjustable manner.

Like the milling discs 14 of the adjacent opener rolls 3,4, the grate bars 11 are arranged mutually offset. A sheet 8 extends in parallel to the roll axes 6,7 between the opener rolls 3,4 over the entire length of the milling discs, the grate bars 10, 11 being mounted at the sheet.

A respective pressure roll 17, 18 is arranged in the direction of movement in front of and behind the opener rolls 3,4. The grate bars 11 extend immediately to the area of action of the pressure roll 17 (18, respectively, on the other side).

The pressure rolls 17,18 may consist of an insulated roll having a metal surface, forming the contact surface for a metal detector device, whereas the other contact surface is provided by the grate bars 11 connected with the housing.

A metal particle that electrically bridges one pressure roll 17, 18 to the grate bars 11 triggers an alarm signal that is used for a quick stop of the opening device. In doing so, it is possible to stop the feed movement of the milling head and the rotary movement of the opener rolls.

The fact that the metal detector device can provide a quick-stop signal before the milling discs 14 of the opener rolls 3,4 come into contact with the metal particle, largely eliminates sparking at the moment of the detection of metal.

It is provided in a further embodiment that the grate 10 is insulated against the housing and that it forms the contact surface insulated against the ground potential, whereas non-insulated pressure rolls 17, 18 form the ground contact surface. In this way, it is achieved to provide metal detection not only between the pressure rolls 17, 18 and the grate 10, but also between the milling discs and the grate 10.

The gap width of the gap 20 between the ends of the grate bars 11 and the working and engaging range of the pressure rolls 17,18 or the opener discs 14, respectively, is preferably 8 mm.

What is claimed is:

1. In a device for opening pressed fibre bales by means of a reduction device movable over the surface of a bale or a row of bales, the reduction device having at least one opening roll, pressure rolls being disposed axially parallel on both sides of the reduction device, milling discs provided on each of the opening rolls, meshing with a grate having bars between the milling discs that engage the bale surface, and a metal detector device, the improvement wherein:

the grate bars extend towards the pressure rolls to the immediate vicinity thereof; and wherein the metal detector device includes the grate bars and said pressure rolls, said grate bars forming a first contact surface, and said pressure rolls forming a second contact surface, defining a gap therebetween whereby said pressure rolls and said grate bar serve as a metal detector.

2. The opening device according to claim 1 wherein said pressure rolls consist of a roll insulated against the casing, having a metal surface.

3. The opening device according to claim 1 wherein said grate bars are insulated with respect to the casing, and the pressure rolls as well as the opening rolls are at ground potential.

4. The opening device according to claim 1 wherein opening the grate bars extend beyond a center line between said opening rolls approaching an outer circumference of the milling discs.

5. The opening device according to claim 1 wherein a gap between the ends of the grate bars and the outer circumference of said pressure rolls or the opener rolls, respectively, is from about 5 to about 15 mm.

6. The opening device according to claim 5, wherein said gap is about 8 mm.

* * * * *

UNITED STATES PATENT AND TRADEMARK OFFICE

CERTIFICATE OF CORRECTION

PATENT NO. : 4,993,117

DATED : Feb. 19, 1991

INVENTOR(S) : Akiva Pinto et al.

It is certified that error appears in the above-identified patent and that said Letters Patent is hereby corrected as shown below:

ON TITLE PAGE: Item [75] Inventors, delete "LucaBen" and insert --Lucassen--.

Signed and Sealed this

Thirty-first Day of December, 1991

*Attest:*

HARRY F. MANBECK, JR.

*Attesting Officer*

*Commissioner of Patents and Trademarks*